US005975038A

United States Patent [19]

Fischer et al.

[11] Patent Number: 5,975,038

[45] Date of Patent: Nov. 2, 1999

[54] PUSHROD FOR OPERATING THE VALVE GEAR MECHANISM OF AN INTERNAL COMBUSTION ENGINE

[75] Inventors: Gerald Fischer, Höchstadt; Walter Speil, Ingolstadt, both of Germany

[73] Assignee: Ina Wälzlager Schaeffler OHG, Herzogenaurach, Germany

[21] Appl. No.: 09/101,130

[22] PCT Filed: Dec. 20, 1996

[86] PCT No.: PCT/EP96/05777

§ 371 Date: Jun. 30, 1998

§ 102(e) Date: Jun. 30, 1998

[87] PCT Pub. No.: WO97/28356

PCT Pub. Date: Aug. 7, 1997

[30] Foreign Application Priority Data

Feb. 3, 1996 [DE] Germany ..... 196 03 916

[51] Int. Cl.[6] ..... F01L 1/24

[52] U.S. Cl. ..... 123/90.55; 123/90.5

[58] Field of Search ..... 123/90.48, 90.49, 123/90.5, 90.52, 90.55

[56] References Cited

U.S. PATENT DOCUMENTS

| | | | |
|---|---|---|---|
| 4,951,619 | 8/1990 | Schaeffler | 123/90.55 |
| 5,651,335 | 7/1997 | Elendt et al. | 123/90.16 |

FOREIGN PATENT DOCUMENTS

| | | |
|---|---|---|
| 01 87 217 A1 | 7/1986 | European Pat. Off. . |
| 0 257 354 A1 | 3/1988 | European Pat. Off. . |
| 0 443 146 A1 | 8/1991 | European Pat. Off. . |
| 0 591 533 A1 | 4/1994 | European Pat. Off. . |
| 33 39 773 A1 | 6/1984 | Germany . |
| 40 05 261 A1 | 8/1991 | Germany . |
| 93 06 685 U | 6/1993 | Germany . |
| 43 43 876 A1 | 6/1995 | Germany . |
| WO 93/05277 | 3/1993 | WIPO . |

*Primary Examiner*—Weilun Lo
*Attorney, Agent, or Firm*—Henry M. Feiereisen

[57] ABSTRACT

A tappet for the valve drive of an internal combustion engine, includes a cup-shaped housing (1) and an insert which is arranged inside the housing (1) and has an outer sleeve (4), which bears upon the cylinder wall, and an inner guide tube (5). Displaceably guided in the guide tube (5) is a hydraulic clearance compensation element (7), with the insert forming with the cylinder wall (2) of the housing (1) an oil channel (17) which extends from a bottom-distant inlet opening (18) of the cylinder wall (2) to a port adjacent an oil chamber (13, 15) and neighboring the bottom (3). In accordance with the invention, the oil channel (19) on the insert is designed as a helical groove formed in the outer sleeve (4). When the tappet is secured against rotation inside the cylinder head bore and so arranged with inclined longitudinal axis that the port (20) is always at the highest point, hydraulic oil is prevented from flowing from the filling chamber (13, 15) into the oil channel (19) and thus is prevented from flowing out of the oil chamber (13, 15) when the internal combustion engine is shut down.

7 Claims, 3 Drawing Sheets

PUSHROD FOR OPERATING THE VALVE GEAR MECHANISM OF AN INTERNAL COMBUSTION ENGINE

FIELD OF THE INVENTION

The invention relates to a tappet for the valve drive of an internal combustion engine, including a cup-shaped housing formed by a bottom and a cylinder wall, and an insert arranged inside the housing and including an outer sleeve, which bears upon the cylinder wall, as well as an inner guide tube connected with the sleeve and displaceably guiding therein a hydraulic clearance compensation element, with the insert forming with the cylinder wall an oil channel extending from a bottom-distant inlet opening of the cylinder wall to a port adjacent an oil chamber and neighboring the bottom, and with a piston part of the clearance compensation element subdividing the oil chamber in an inner oil reservoir and an outer oil reservoir which are connected to one another via a transfer opening arranged in the bottom.

BACKGROUND OF THE INVENTION

Hydraulic cup-shaped tappets with valve clearance compensation elements and inserts for restriction of the oil amount and maintaining the required oil reservoir in the compensation element are known. Document EP 0 443 146 B1 shows a tappet having an insert formed in one piece with the cylinder wall of the cup-shaped housing, resulting in a complicated structure and assembly.

Document DE 36 38 202 A1 discloses a tappet having a hydraulic clearance compensation element and provided with an anti-rotation device by means of a needle roller which partially projects out of the tappet housing and snugly fits in a groove of the machine part that surrounds the tappet and has a bore for guiding the tappet for displacement in an axial direction. This arrangement is however not directed to a cup-shaped tappet but to a differently designed roller tappet.

Document EP 0 187 217 B1 shows a cup-shaped tappet of the afore-stated type which slightly rotates about its longitudinal axis during reciprocating movement in the cylinder head bore. When this tappet is so arranged in the cylinder head that its longitudinal axis is inclined with respect to the vertical, the inlet opening for the hydraulic oil may migrate between a highest position and a lowest position. Even when the inlet opening has reached its lowest position, the inner oil reservoir of the clearance compensation element remains completely filled with a minimum amount when the combustion engine is shut down because the transfer opening, which connects the inner oil reservoir with the outer oil reservoir, is located at its highest point since in this design the port of the oil channel and the transfer opening oppose each other diametrically.

Thus, in view of the fact that the transfer opening as outlet of the inner reservoir occupies its highest point when the inlet opening is at its lowest point, oil is prevented from flowing out of the inner reservoir. However, in this disposition, the hydraulic oil may flow back at least partially from the outer oil reservoir, which surrounds the inner oil reservoir, via the port, the oil channel and the inlet opening into the supply conduit of the cylinder head. When the internal combustion engine is started again, the partially emptied outer oil reservoir of each cup-shaped tappet must therefore be filled first before the tappet exhibits its even operating behavior.

SUMMARY OF THE INVENTION

The invention is based on the object to so develop the tappet that the entire supply of hydraulic oil is available at any time to positively eliminate irregular operating behavior, in particular during the starting phase, and thus prevent e.g. resultant rattling noises.

This object is attained in accordance with a first proposal of the invention by configuring the insert of the oil channel as a helical groove formed in the outer sleeve. When arranging the tappet and the tappet bore in the cylinder head with inclined axis, the inlet opening for the hydraulic oil can then occupy the lowest point, with the port of the oil channel occupying its highest point so that oil is prevented from escaping from the outer oil reservoir.

According to another proposal, the object is attained in accordance with the invention by providing the oil channel on the insert in the form of a circumferential groove and adjoining axis-parallel surface groove (riser groove) which is formed in the outer sleeve. The inlet opening of the cup-shaped housing and the port of the oil channel may be angularly offset to one another, preferably in diagonally opposite disposition, with the circumferential groove extending either over only part of the circumference or about the entire circumference of the outer sleeve over a radian measure of 360°.

In order to maintain its position, the insert may be formed with a hollow space for receiving a rotation-preventing body, whereby the cylinder wall may have an opening in the area of the hollow space, and the rotation-preventing body may partially traverse through the opening of the cylinder wall and be disposed in the hollow space of the insert and partially project out of the housing.

Such an insert, formed with the oil channel as well as with the hollow space for the rotation-preventing body may be fabricated for example as formed piece of sheet metal in a simple manner and mounted in the tappet housing. The rotation-preventing body may be designed as needle roller which is arranged in the opening in axis-parallel disposition with respect to the housing.

BRIEF DESCRIPTION OF THE DRAWING

Exemplified embodiments of the invention will now be described in more detail with reference to the drawing, in which.

DETAILED DESCRIPTION OF THE DRAWING

Figure 1:
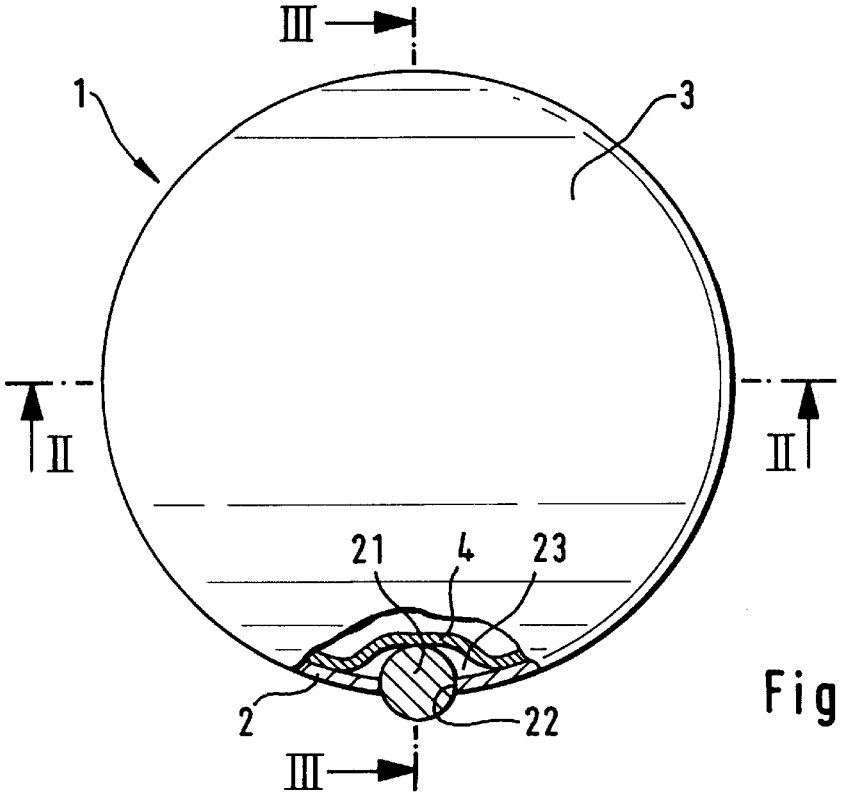
FIG. 1 is a plan view of a tappet according to the invention, with a partial cross section in the area of the anti-rotation device.
Figure 2:
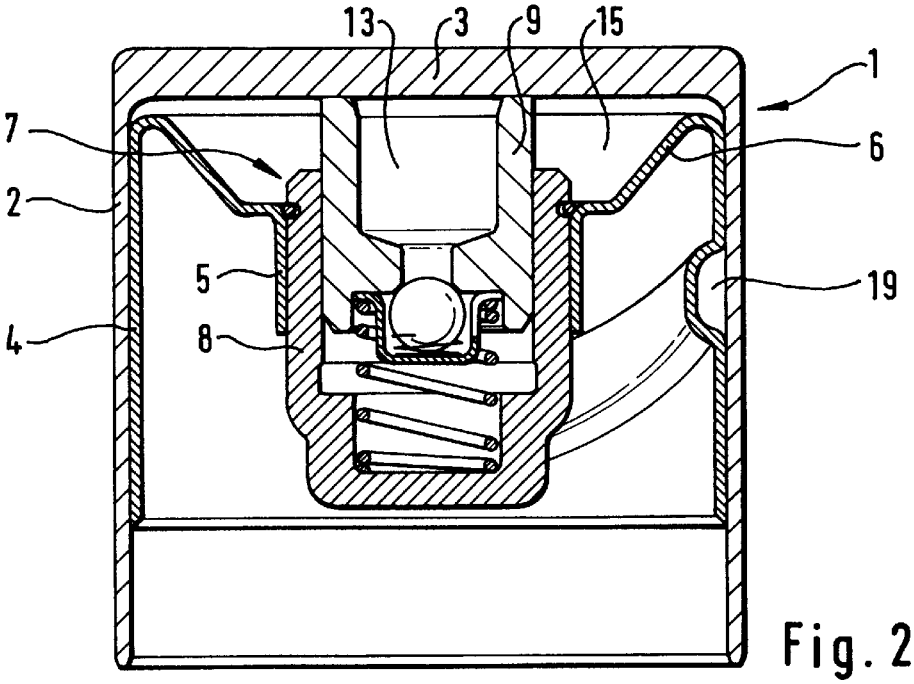
FIG. 2 is a longitudinal section through the tappet, taken along line II—II of FIG. 1.
Figure 3:
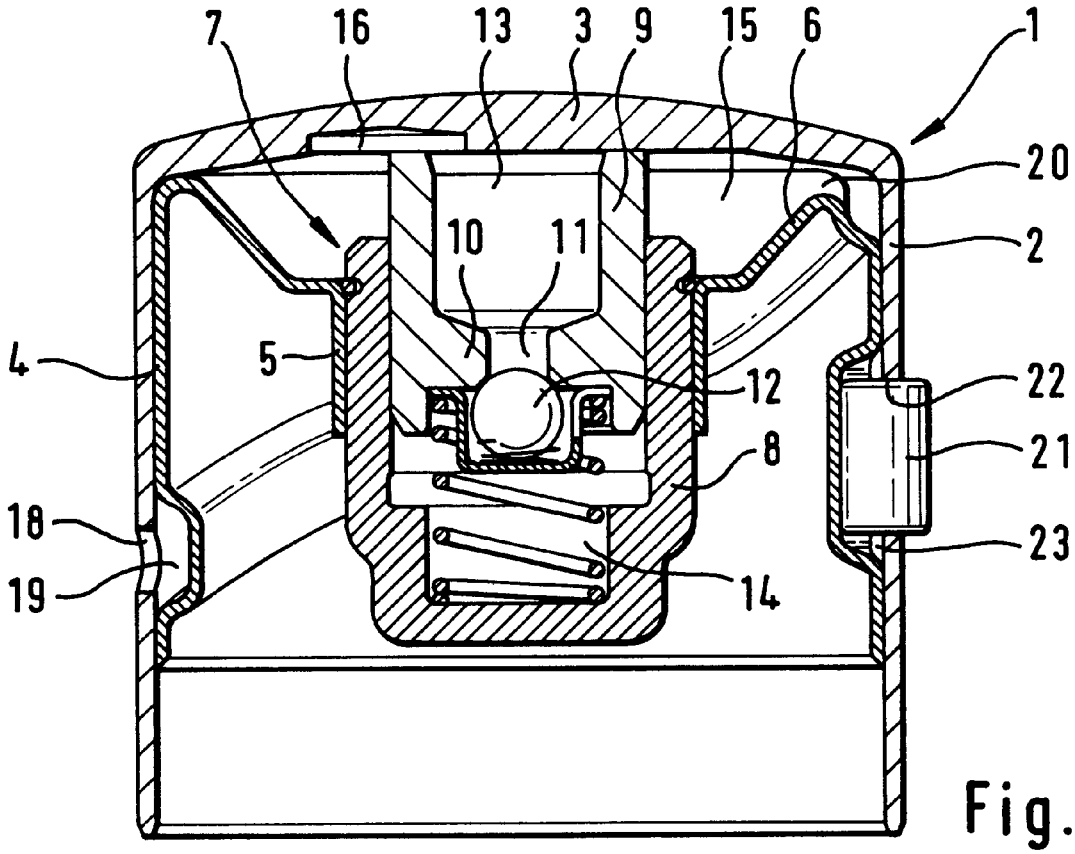
FIG. 3 is a further longitudinal section through the tappet, taken along the line III—III of FIG. 1.
Figure 4:
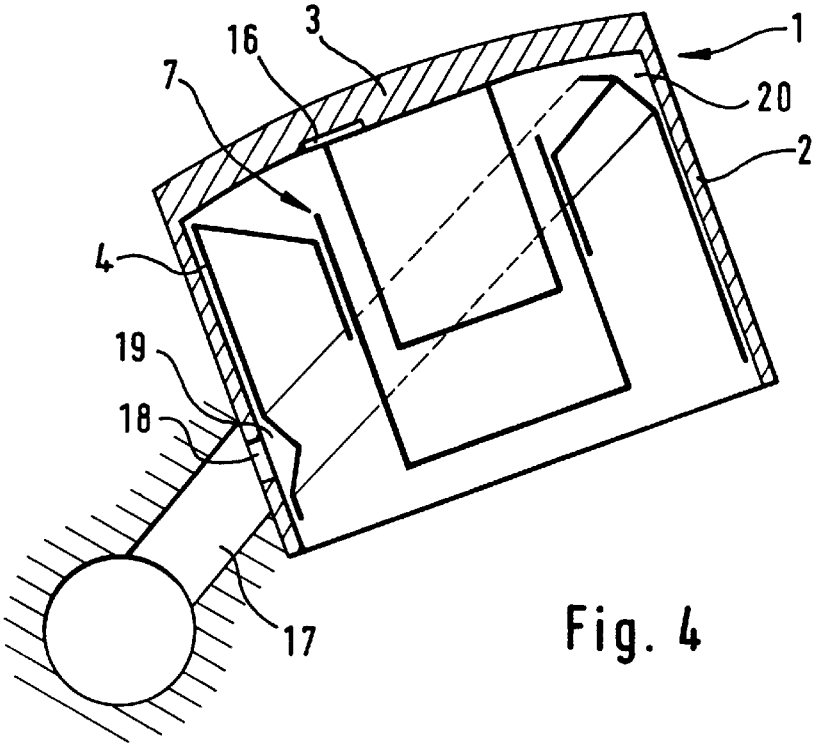
FIG. 4 is a schematic illustration of this tappet inserted with inclined axis in the cylinder head.

A tappet according to the invention and illustrated in FIGS. 1 to 4 includes a cup-shaped housing 1 which has a tubular cylinder wall 2 closed on one end by a bottom 3. Supported by the bottom 3 in the bore of the cylinder wall 2 is a sheet metal insert comprised of an outer sleeve 4, an inner guide tube 5 and a funnel-shaped ring 6 which interconnects the outer sleeve 4 and the inner guide tube 5 in vicinity of the bottom 3. The outer sleeve 4, which bears on the cylinder wall 2, and the inner guide tube 5 are arranged coaxially to one another inside the housing 1.

The inner guide tube 5 effects an axial guidance of a hydraulic clearance compensation element 7 which includes an outer cylinder part 8 guided in the guide tube 5 for displacement in the longitudinal direction. The outer cylinder part 8 is closed on its end distant to the bottom 3 of the housing 1 and has a bore accommodating a piston part 9 which is guided therein at slight play for displacement in the longitudinal direction and formed by a hollow-cylindrical jacket which includes between its ends a partition wall 10 with a through-bore 11 that is closed by a ball check valve 12. The piston part 9 has one end supported by the inside of the bottom 3 and includes an inner oil reservoir 13 disposed anteriorly of the check valve 12. The other end thereof demarcates together with the cylinder part 8 an high-pressure oil chamber 14 which is closed off by the ball check valve 12.

Hydraulic oil necessary for operation of the clearance compensation element 7 flows into the inner oil reservoir 13 from an outer oil reservoir 15 which concentrically surrounds the piston part 9 and is bounded by the bottom 3 and the funnel-shaped ring 6. In order to enable an oil transfer from the outer oil reservoir 15 into the inner oil reservoir 13, the bottom 3 is formed with a transfer opening 16 in a circumferential area of the interface between the piston part 9 and the inside surface of the bottom 3.

Hydraulic oil flows from the cylinder head via a supply conduit 17 of the cylinder head through an inlet opening 18 of the cylinder wall into an oil channel 19. In accordance with the invention, this channel is configured as helical groove which is formed in the outer sleeve 4 of the insert. This groove is open toward the outside so that the oil channel 19 is formed by this groove together with the inner surface of the cylinder wall 2. The inlet opening 18 is disposed at a location distant to the bottom 3 of the housing 1. Oil flows via the helical oil channel 19 to a port 20 which is situated at the outer oil reservoir 15 in vicinity of the bottom 3 and forms the other end of the oil channel 19.

In order to ensure that the port 20 is always disposed at the highest point when the longitudinal axis of the housing 1 is arranged at an inclination in the cylinder head, the tappet is provided with an anti-rotation device so as to prevent a rotation thereof about its longitudinal axis during operation. The anti-rotation device is formed by a cylindrical rotation-preventing body 21, e.g. a needle roller, inserted in an opening 22 of the cylinder wall 2 in parallel disposition to the longitudinal axis of the housing 1.

As the diameter of the rotation-preventing body 21 significantly exceeds the wall thickness of the cylinder wall 2, the rotation-preventing body 21 projects partially into as well as out of the housing 1. The outwardly projecting part snugly fits in a longitudinal groove of the cylinder head which is accessible from the tappet bore thereof. The part of the rotation-preventing body 21 projecting inwardly into the housing 1 is received in an outwardly open hollow space 23 formed in the outer sleeve 4 of the insert and located in the area of the opening 22 of the cylinder wall 2. This hollow space 23 is formed in a same manner as the oil channel 19 within the single piece sheet metal form part which constitutes the insert, i.e. in the outer sleeve 4 thereof.

Figure 5:
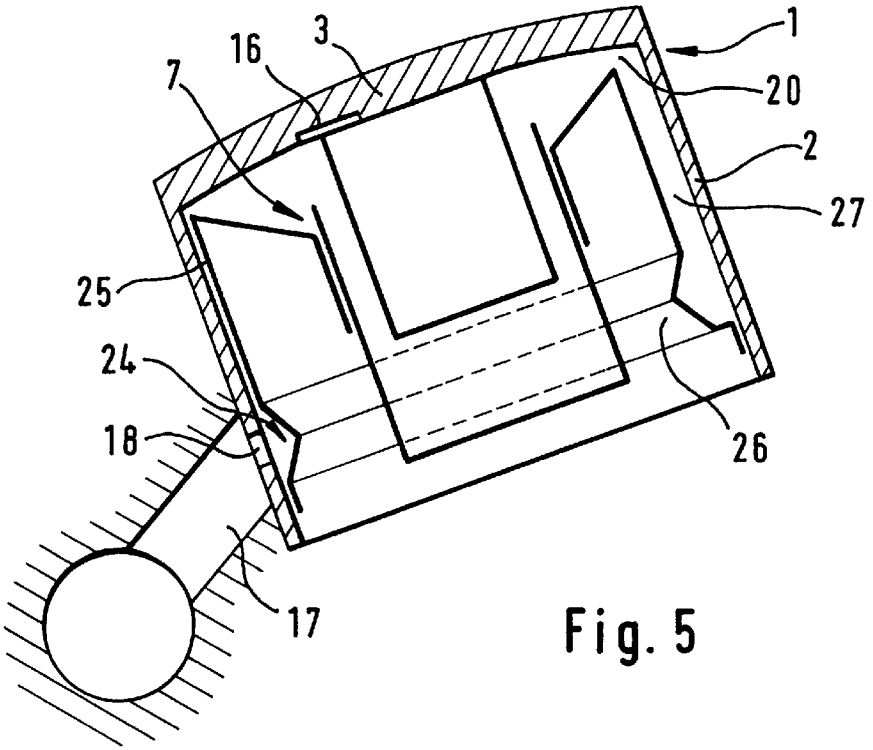
FIG. 5 is a schematic illustration of a modified tappet in correspondence to FIG. 4.

FIG. 5 shows a tappet according to the invention with differs from the afore-described tappet in that its oil channel 24 is not configured by a helical groove but by a circumferential groove 26 and an adjoining surface groove 27 which are formed in the outer sleeve 25 of the insert. The surface groove 27 extends axis-parallel to the insert of the housing 1 and operates as riser line.

In this exemplified embodiment, the circumferential groove 26 extends about the entire circumference of the outer sleeve 25 over a radiant measure of 360°, with the inlet opening 18 of the housing 1 and the port 20 of the oil channel 24 located in diagonally opposite disposition. It is also possible to provide the circumferential groove only over a part of the sleeve circumference so that the inlet opening 18 of the cylinder wall 2 and the surface groove 27 with the port 20 are arranged on the sleeve 25 offset at an angle which is less than 180°.

What is claimed is:

1. A tappet for a valve drive of an internal combustion engine, comprising;

a cup-shaped housing formed by a bottom and a cylinder wall;

an insert arranged inside the housing and forming with the housing an oil chamber, said insert including an outer sleeve which bears upon the cylinder wall and is so shaped as to define a hollow space, and an inner guide tube which is connected to the sleeve, said insert and said cylinder wall defining an oil channel which is formed in the outer sleeve of the insert and has the shape of a helical groove extending from a bottom-distant inlet opening of the cylinder wall to a port adjacent the oil chamber and neighboring the bottom;

a hydraulic clearance compensation element displaceably guided in the guide tube and having a piston part which subdivides the oil chamber into an inner oil reservoir and an outer oil reservoir connected to one another via a transfer opening arranged in the bottom; and a rotation-preventing body so supported in an opening of the cylinder wall of the housing as to project into the hollow space formed in the outer sleeve of the insert and to project out of the housing.

2. The tappet of claim 1 wherein the rotation-preventing body is formed as a needle roller which is arranged in the opening in an axis-parallel disposition to the housing.

3. A tappet for a valve drive of an internal combustion engine, comprising:

a cup-shaped housing formed by a bottom and a cylinder wall;

an insert arranged inside the housing and forming with the housing an oil chamber, said insert including an outer sleeve which bears upon the cylinder wall and is so shaped as to define a hollow space, and an inner guide tube which is connected to the sleeve, said insert and said cylinder wall defining an oil channel which is formed by a circumferential groove and an adjoining axis-parallel surface groove which are formed in the outer sleeve of the insert, said oil channel extending from a bottom-distant inlet opening of the cylinder wall to a port adjacent the oil chamber;

a hydraulic clearance compensation element displaceably guided in the guide tube and having a piston part which subdivides the oil chamber into an inner oil reservoir and an outer oil reservoir connected to one another via a transfer opening arranged in the bottom; and a rotation-preventing body so supported in an opening of the cylinder wall of the housing as to project into the hollow space formed in the outer sleeve of the insert and to project out of the housing.

4. The tappet of claim 3 wherein the inlet opening of the housing and the port are arranged angularly offset to one another.

5. The tappet of claim 4 wherein the inlet opening of the housing and the port are arranged diagonally opposite to one another.

6. The tappet of claim 3 wherein the circumferential groove extends about the entire circumference of the outer sleeve over a radian measure of 360°.

7. The tappet of claim 3 wherein the rotation-preventing body is formed as a needle roller which is arranged in the opening in an axis-parallel disposition to the housing.

* * * * *